US007144243B2

(12) United States Patent
Stephenson et al.

(10) Patent No.: US 7,144,243 B2
(45) Date of Patent: Dec. 5, 2006

(54) TUBING EXPANSION

(75) Inventors: David Stephenson, Dubai (AE); Grant Adams, Aberdeen (GB); David H. Grant, Ellon (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 416 days.

(21) Appl. No.: 10/306,490

(22) Filed: Nov. 27, 2002

(65) Prior Publication Data

US 2003/0127774 A1 Jul. 10, 2003

(30) Foreign Application Priority Data

Nov. 30, 2001 (GB) ..... 0128667.3

(51) Int. Cl.
*B29C 67/00* (2006.01)

(52) U.S. Cl. ..... 425/387.1; 425/393; 425/DIG. 218; 166/380; 72/393

(58) Field of Classification Search ..... 425/387.1, 425/392–393, DIG. 218; 166/380; 72/370.08, 72/393; 249/178, 180
See application file for complete search history.

(56) References Cited

U.S. PATENT DOCUMENTS

| | | | | |
|---|---|---|---|---|
| 2,627,891 | A | 2/1953 | Clark | |
| 2,898,971 | A * | 8/1959 | Hempel | 29/523 |
| 3,191,680 | A | 6/1965 | Vincent | |
| 3,203,483 | A | 8/1965 | Vincent | |
| 3,785,193 | A | 1/1974 | Kinley et al. | |
| 3,991,150 | A * | 11/1976 | De Putter | 264/68 |
| 4,107,249 | A * | 8/1978 | Murai et al. | 425/387.1 |
| 4,239,473 | A * | 12/1980 | Fulhaber | 425/392 |
| 4,779,678 | A * | 10/1988 | White | 166/241.3 |
| 5,014,779 | A | 5/1991 | Meling et al. | |
| 6,176,313 | B1 | 1/2001 | Coenen et al. | |
| 6,382,333 | B1 * | 5/2002 | Murray | 166/241.3 |
| 6,425,444 | B1 | 7/2002 | Metcalfe et al. | 166/387 |
| 6,457,532 | B1 | 10/2002 | Simpson | 166/380 |
| 6,629,567 | B1 * | 10/2003 | Lauritzen et al. | 166/380 |
| 6,752,215 | B1 * | 6/2004 | Maguire et al. | 166/380 |
| 2001/0020532 | A1 | 9/2001 | Baugh et al. | |
| 2001/0045284 | A1 | 11/2001 | Simpson et al. | |

FOREIGN PATENT DOCUMENTS

| | | |
|---|---|---|
| WO | WO 97/20130 | 6/1997 |
| WO | WO 00/37766 | 6/2000 |
| WO | WO 01/46551 | 6/2001 |
| WO | WO 01/83932 | 11/2001 |
| WO | WO 02/59456 | 8/2002 |

OTHER PUBLICATIONS

PCT Search Report, International Application No. PCT/GB 02/05387, dated Mar. 26, 2003.
GB Search Report, Application No. GB 0128667.3 dated Mar. 7, 2002.

* cited by examiner

*Primary Examiner*—Yogendra N. Gupta
*Assistant Examiner*—Thu Khanh T. Nguyen
(74) *Attorney, Agent, or Firm*—Patterson & Sheridan, L.L.P.

(57) ABSTRACT

A tubing expansion device (20) is adapted to be advanced axially, without rotation, through tubing (10) to be expanded. The device (20) comprises a body (22) and a plurality of expansion members (30,32,34) mounted on the body (22), the expansion members (30,32,34) being independently radially movable. The expansion members may be rotatable, or may be non-rotating.

34 Claims, 4 Drawing Sheets

TUBING EXPANSION

FIELD OF THE INVENTION

This invention relates to a device for use in tubing expansion, and also to a method of expanding tubing. In particular, embodiments of the invention relate to devices and methods for use in expanding tubing downhole.

BACKGROUND OF THE INVENTION

In the oil and gas exploration and production industry, bores drilled to access subsurface hydrocarbon-bearing reservoirs are lined with tubing, known as casing and liner. Furthermore, strings of tubing may be located within the cased bore to, for example, carry production fluid to surface. Recently, there have been numerous proposals to use tubing which is expanded downhole, that is tubing of a first diameter is run into a bore and then expanded to a larger second diameter downhole. This offers many advantages to the operator, primarily providing the ability to create lined bores which do not necessarily suffer a loss in internal diameter each time a string of tubing is located in the bore, beyond an existing section of tubing-lined bore.

Early proposals for expanding tubing downhole featured the use of cones or mandrels, which are driven through the tubing in order to expand the tubing. Other proposals include the use of roller expanders, which feature radially-urged rollers. The expanders are rotated within the tubing, and create a reduction in the wall thickness of the tubing, with a corresponding increase in diameter.

It is among the objectives of embodiments of the present invention to provide improved devices and methods for use in expanding tubing downhole.

SUMMARY OF THE INVENTION

According to a first aspect of the present invention there is provided a tubing expansion device, the device being adapted to be advanced axially through tubing to be expanded and comprising:

a body; and a plurality of independently radially movable expansion members mounted on the body.

According to a further aspect of the present invention there is provided a method of expanding tubing, the method comprising the steps of:

providing an expansion device comprising a body and a plurality of independently radially movable expansion members mounted on the body;

moving the expansion device substantially axially through tubing to be expanded such that the expansion members are translated axially relative to the tubing; and urging the expansion members radially outwards into contact with an inner wall of the tubing.

The provision of independently movable expansion members allows devices and methods in accordance with embodiments of the invention to operate in situations where it is difficult or impossible to expand tubing to a uniformly cylindrical configuration, that is the device is "compliant". This is in contrast to the situation where an expansion cone or mandrel is utilised; if an area of the tubing wall cannot be expanded to the cone diameter, the cone will be unable to pass, and may indeed become stuck fast in the tubing. Furthermore, the use of an axially movable expansion device avoids one of the difficulties associated with conventional rotary expansion systems, which apply significant rotational torques to the tubing. In some cases, the torques may be sufficient to induce permanent rotational strain in the tubing, particularly in slotted tubing. The application of significant rotational torques to tubing strings undergoing expansion also has the potential to create problems at threaded couplings between tubing sections.

Preferably, the expansion members are one or both of axially and circumferentially spaced.

Preferably, the expansion process is carried out downhole. In this application the ability of the device to accommodate variations in tubing profile or diameter is particularly useful, as it will often be the case that downhole tubing, whether in the form of casing or liner being expanded within a previously unlined or open bore, or a hanger or other tubing form being expanded within a larger diameter tubing, will encounter irregularities or restrictions that prevent expansion of the tubing to a constant diameter uniformly cylindrical configuration.

At least one of the plurality of expansion members may be radially movable relative to the body; the other of the expansion members may be radially fixed relative to the body. For example, three expansion members may be located at 120 degrees spacing on the body, and if one member is radially movable the device may still be capable of accommodating irregular expansion of the tubing. However, it is preferred that all of the expansion members are radially movable.

Preferably, at least one of the expansion members is rotatable, most preferably about an axis which lies substantially perpendicular to the tubing axis. Most preferably, a plurality of the expansion members are rotatable. This configuration of expansion member will tend to reduce the friction between the expansion members and the tubing inner wall, reducing the force necessary to move the device through the tubing and also reducing the rate of wear experienced by the expansion members. One or more of the expansion members may be non-rotating, and provide for a predominantly sliding contact with the tubing wall. The faces of such members will typically be formed from a suitable wear-resistant material, such as a ceramic or a relatively hard metallic compound or alloy, and may be lubricated by well fluid or by fluid or material specifically provided for its lubrication properties.

In addition to the circumferentially spaced independently radially movable expansion members, further expansion members may be provided on the body which are collectively movable, that is the expansion members are not independently radially movable, or are non-compliant. Other expansion members may define a fixed diameter. Typically, any non-compliant or fixed diameter members will be located towards a leading end of the expander, and will be utilised to provide an initial degree of expansion.

The expansion members may be actuated by any appropriate means, including hydraulic actuation or mechanical actuation. In other embodiments the expansion members may be electrically actuated, or may be chemically or explosively actuated. Conveniently, the expansion members are mounted on pistons which are located in appropriate recesses or ports in the body, such that an elevated pressure within the body urges the piston, and thus the expansion member, radially outwardly. In other embodiments, axially movable pistons may be provided, which pistons act, via cams or the like, on radially movable keys or fingers. Alternatively, the expansion members may be urged outwardly by springs or other biassing means, or the members themselves may be flexible or compliant or comprise flexible or compliant portions.

Preferably, the expansion device is provided in combination with driving means for applying an axial motive force to the body. The driving means may be located remotely of the body, for example where the invention is being utilised to expand tubing downhole, an arrangement may be provided on surface for applying weight to a member on which the device is mounted. Alternatively, or in addition, the driving means may be arranged to engage the tubing in which the device is located. In some embodiments, the driving means may feature seals for engaging the tubing inner surface, such that a fluid pressure differential across the seals creates an axial force on the device. The seals may be adapted for engaging the expanded tubing wall, particularly if the unexpanded tubing wall is non-cylindrical. However, it is preferred that the seals are adapted for engaging the unexpanded tubing wall, as this is likely to be of a consistent form; the invention is primarily intended for use in situations where there is a possibility that the expanded tubing may include irregularities. The location of the seals on the unexpanded tubing, that is in front of or below the device, also provides the numerous advantages as set out in our earlier application WO02081863, the disclosure of which is incorporated herein by reference. Briefly, the elevated fluid pressure surrounding the device may be utilised to assist in expanding the tubing, and also serves to lubricate the device.

In other embodiments, the driving means may comprise a tractor of the like for pushing or pulling the device through the tubing.

In still further embodiments, the driving means may comprise an anchor or other gripping arrangement for engaging the tubing forwardly or rearwardly of the device, such that the device may then be pulled or pushed through the tubing relative to the fixed anchor. It is most preferred that such an anchor is provided forwardly of the device, such that the device is pulled through the tubing. This offers the advantage that the tubing form and dimensions at the anchor location are known, such that the anchor may be dimensioned appropriately, and it is more likely that the anchor will be securely and reliably located in the tubing.

The driving means may further comprise an arrangement to provide a hammer or impulse force to the device, or to vibrate the device. Downhole hammers and shock tools suitable for this purpose are known to those of skill in the art, and further arrangements are also disclosed in our earlier application no. GB0114872.5, the disclosure of which is incorporated herein by reference.

Of course, the driving means may utilise any number of different arrangements, for example a combination of weight applied from surface and fluid pressure, or a combination of fluid pressure and mechanical force used to draw the device through tubing towards an anchor. Most preferably, the anchor is releasable.

The unexpanded tubing may take any appropriate form, and may have a cylindrical wall, a corrugated generally cylindrical wall, or the unexpanded tubing wall may be folded, such that the expansion process involves, at least in part, an unfolding of the wall. Thus the expansion of the tubing may involve one or both of circumferential extension of the wall and a re-configuration of the wall.

The tubing may be solid-walled, slotted or perforated, holed, partially holed, that is with areas of reduced wall thickness, or indeed may take any form. The tubing may comprise multiple elements, and may be in the form of a sand screen or the like.

The tubing will typically be metallic, but may be of any material or combination of materials appropriate to the circumstances.

The tubing may be formed of a plurality of tubing sections, or may be a substantially continuous length, for example a spoolable or reelable tubing.

The tubing may be located in open hole, or may be located within a larger diameter tubing or bore. Typically, the tubing will be expanded into contact with the surrounding bore wall or larger diameter tubing.

These and other aspects of the present invention will now be described, by way of example, with reference to the accompanying drawings, in which.

Figure 1:
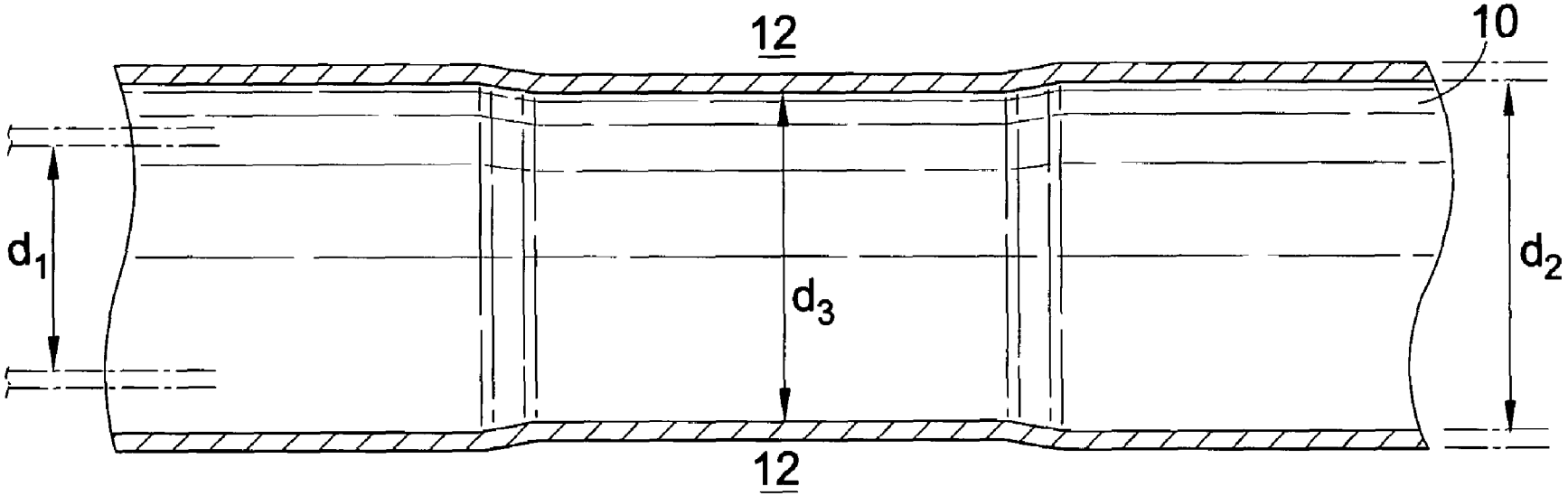
FIG. 1 is a diagrammatic illustration of expanded tubing.

Reference is first made to FIG. 1 of the drawings, which illustrates a section of downhole tubing 10 which has been expanded by a tubing expansion device in accordance with an embodiment of the present invention, as will be described. The tubing 10 was originally of diameter $d_1$. However, an expansion device has been run through the tubing 10, with the aim of expanding the tubing to a larger diameter $d_2$. This expansion has brought the outer wall of the tubing 10 into contact with the surrounding open bore wall. However, in one section of the tubing 10 a restriction 12 around the tubing has prevented the expansion of the tubing 10 to diameter $d_2$, and the tubing has only been expanded to a smaller diameter $d_3$.

With many conventional expansion devices, such as expansion cones or mandrels, expansion of the tubing beyond the restriction 12 would not be possible, as the diameter of the cone is fixed and the cone would simply be unable to expand the tubing and progress through the restriction 12. In practice, it is likely that the cone will become stuck at the restriction 12. However, as will be described, by utilising expansion devices in accordance with embodiments of the invention, it is possible to accommodate such restrictions 12.

Figure 2:
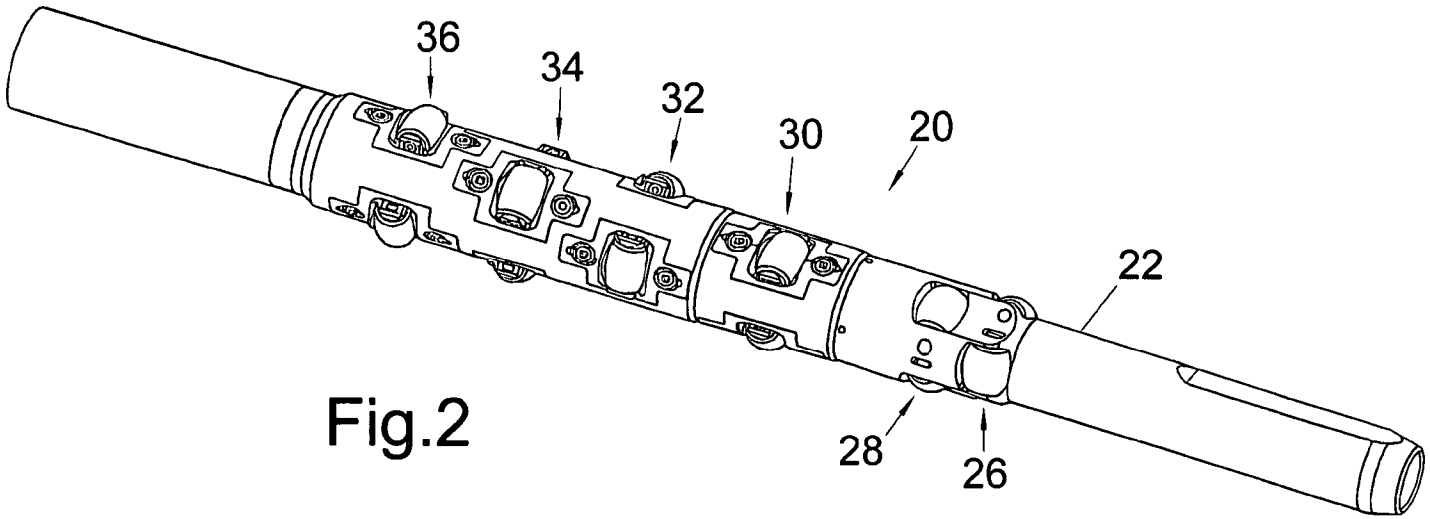
FIG. 2 is a perspective view of a tubing expansion device in accordance with a preferred embodiment of the present invention.
Figure 3:
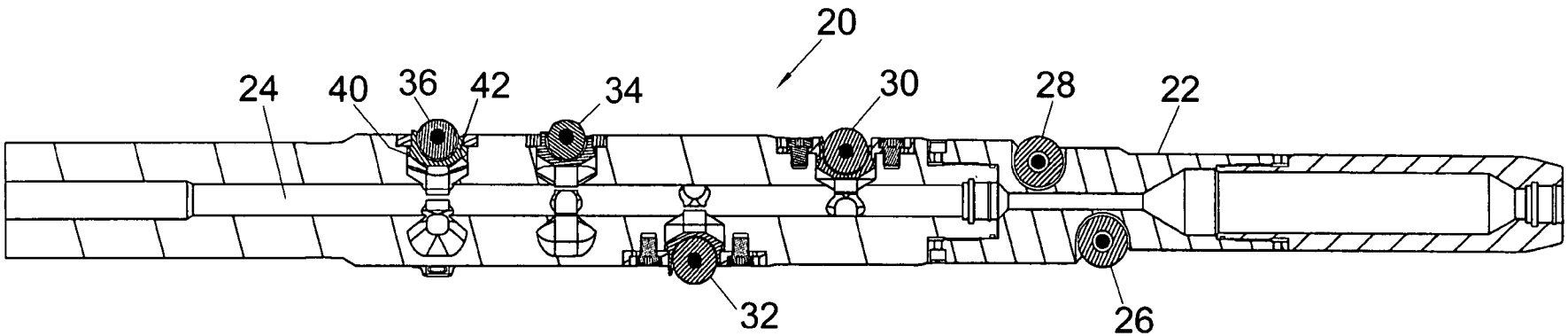
FIG. 3 is a sectional view of FIG. 2.

Reference will now also be made to FIGS. 2 and 3 of the drawings, which illustrate a tubing expansion device 20 in accordance with a preferred embodiment of the present invention. The device 20 comprises a generally cylindrical tubular body 22 adapted for mounting to a support string (not shown). A bore 24 extends through the body 22 to allow fluid to be transmitted therethrough.

At least one roller is mounted in the body 22, and in the preferred illustrated embodiment there are five sets of rollers, each roller with its axis of rotation perpendicular to the main axis of the body 22. Each set of rollers has at least one roller, and in the preferred illustrated embodiment there are three angularly spaced rollers; in this embodiment the rollers are at 120° angular spacings, although other spacings may be adopted if desired. The first and second sets of rollers 26, 28 may be radially fixed, that is the rollers 26, 28 describe a fixed radius. However, the rollers in each of the third, fourth, fifth and sixth sets 30, 32, 34, 36 may be radially movable. In particular, each roller may be mounted on a piston 40 located within a respective radial body recess 42. Each recess 42 is in fluid communication with the body bore 24, such that an elevated fluid pressure within the bore 24 urges the rollers radially outwardly.

In use, the device 20 may be advanced through tubing to be expanded by one of a number of means including application of weight from surface, or use of an anchor located ahead of the device 20, against which the device 20 is pulled through the tubing 10. The fixed radius rollers 26, 28 are dimensioned to describe a diameter slightly larger than $d_1$, such that the rollers 26, 28 will provide an initial degree of expansion of the tubing 10. Further expansion will be provided by the other sets of rollers 30, 32, 34, 36 which, when actuated, describe a larger, maximum diameter and are capable of expanding the tubing 10 to diameter $d_2$.

On encountering a restriction 12, which prevents the tubing 10 from being expanded to diameter $d_2$, the first and second sets of rollers 26, 28 will provide an initial relatively small degree of expansion which will not be affected by the restriction 12. However, on the other rollers 30, 32, 34, 36 encountering the restriction, the tubing 10 will be expanded to the maximum extent permitted by the restriction 12. The rollers 30, 32, 34, 36 will normally operate at their greatest radial extension, corresponding to diameter $d_2$. However, where this is not possible, such as when prevented by the restriction 12, the rollers and their respective pistons will simply be forced radially inwardly relative to the body 22 by the tubing wall. Thus, the rollers 30, 32, 34 will expand the tubing 10 to the maximum extent permitted by the restriction and will still be able to pass through the resulting restriction in the expanded tubing diameter.

FIG. 1 illustrates a restriction in the expanded tubing in the form of a necking of the tubing 10, however as each roller is mounted on a respective independently movable piston, the device 20 will also accommodate a restriction which occurs at only one portion of the circumference.

Figure 4:
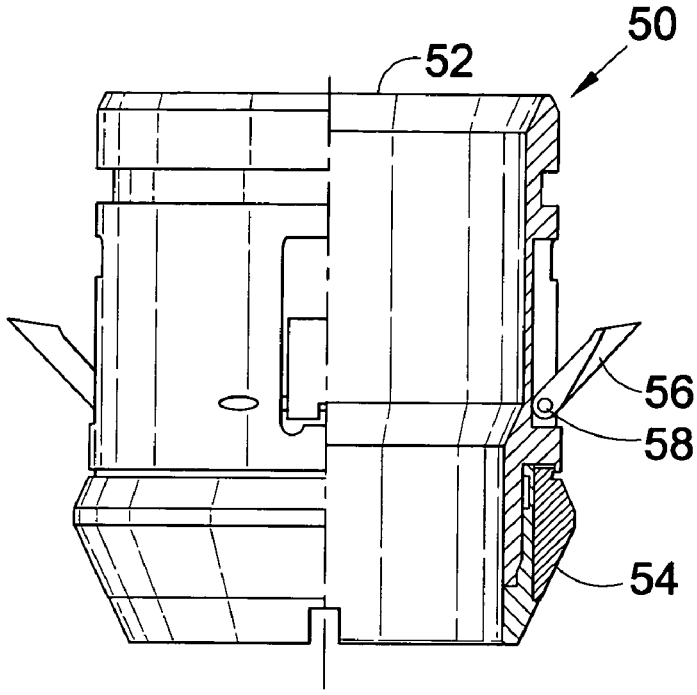
FIGS. 4 and 5 are part-cut away illustrations of tubing expansion devices in accordance with a further embodiment of the present invention.
Figure 5:
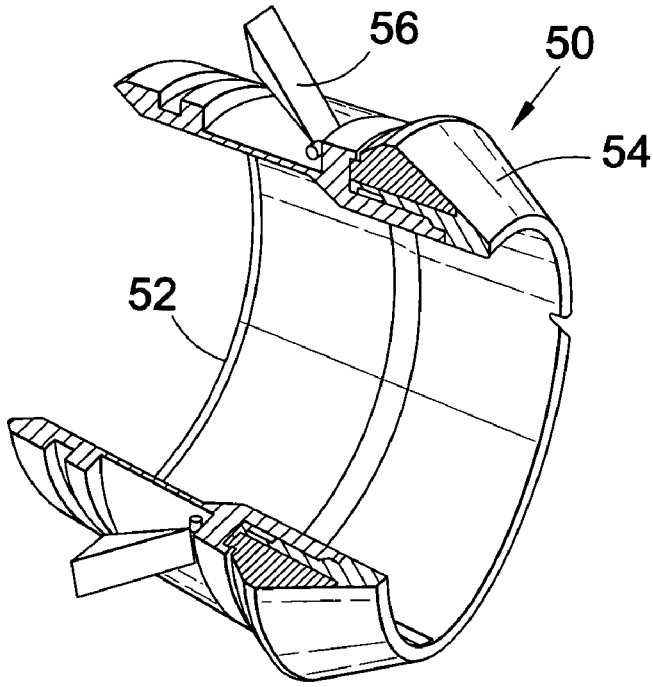

Reference is now made to FIGS. 4 and 5 of the drawings, which illustrate a tubing expansion device 50 in accordance with a further embodiment of the present invention. In this example, the device 50 features a tubular body 52 carrying a leading fixed diameter swage 54 for inducing an initial degree of expansion, in a similar manner to the first and second roller sets 26, 28 described above. Following the fixed swage 54 are circumferentially spaced fingers 56. In this embodiment four fingers 56 are provided and are each mounted on a respective pivot pin 58, the axis of each pin 58 being perpendicular to the body axis. The fingers 56 are biassed radially outward, and in normal circumstances will expand the tubing 10 to the diameter $d_2$. However, on encountering a restriction 12, the fingers 56 may be forced inwardly, such that the device 50 extends the tubing to the intermediate diameter $d_3$ and may pass through and beyond the restriction 12.

Figure 6:
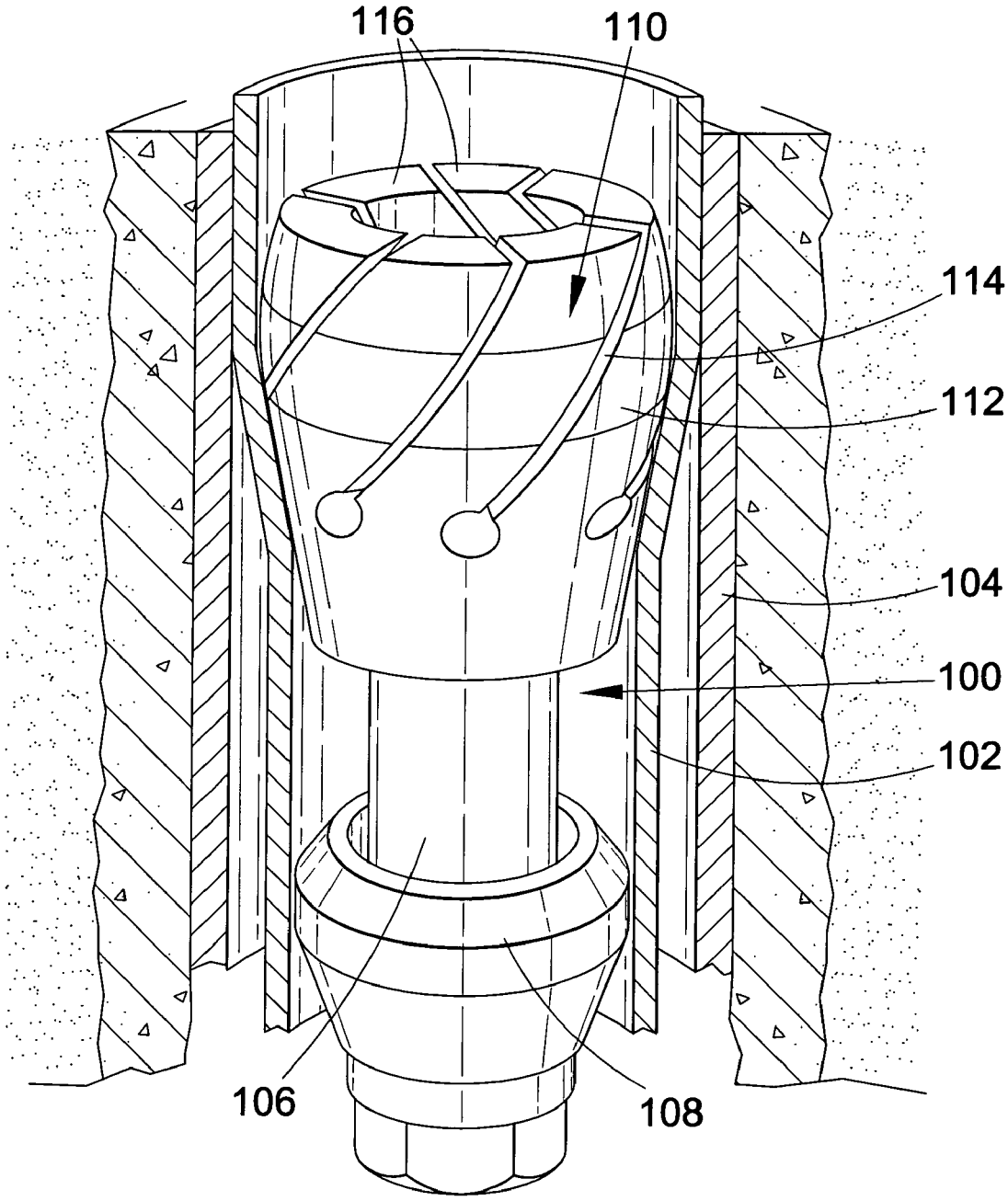
FIG. 6 is a perspective view of a tubing expansion device in accordance with a still further embodiment of the present invention, shown in use.

Reference is now made to FIG. 6 of the drawings, which illustrate a tubing expansion device 100 in accordance with a still further embodiment of the present invention. The device 100 is illustrated located within a section of liner 102 which the device is being used to expand, the illustrated section of liner 102 being located within a section of cemented casing 104; the device 100 is being utilised to create a liner hanger.

In this example, the device 100 features a central mandrel 106 carrying a leading sealing member in the form of a swab cup 108, and an expansion cone 110. The swab cup 108 is dimensioned to provide a sliding sealing contact with the inner surface of the liner 102, such that elevated fluid pressure above the swab cup 108 tends to move the device 100 axially through the liner 102. Furthermore, the elevated fluid pressure also assists in the expansion of the liner 102, in combination with the mechanical expansion provided by the contact between the cone 110 and the liner 102.

The cone 110 is dimensioned and shaped to provide a diametric expansion of the liner 102 to a predetermined larger diameter as the cone 110 is forced through the liner 102. However, in contrast to conventional fixed diameter expansion cones, the cone 110 is at least semi-compliant, that is the cone 110 may be deformed or deflected to describe a slightly smaller diameter, or a non-circular form, in the event that the cone 110 encounters a restriction which prevents expansion of the liner 102 to the desired larger diameter cylindrical form. This is achieved by providing the cone 110 with a hollow annular body 112, and cutting the body 112 with angled slots 114 to define a number, in this example six, deflectable expansion members or fingers 116. Of course the fingers 116 are relatively stiff, to ensure a predictable degree of expansion, but may be deflected radially inwardly on encountering an immovable obstruction.

The slots 114 may be filled with a deformable material, typically an elastomer, or may be left free of material.

The device 100 may also include a leading fixed diameter swage (not shown) for inducing an initial degree of expansion, and furthermore serving to stabilise the cone 110.

It will be apparent to those of skill in the art that the above-described devices provide a convenient and effective means for expanding tubing downhole, and are particularly useful for applications where the ability to expand the tubing to a uniform cylindrical form cannot be assured.

Those of skill in the art will also recognise that these embodiments are merely exemplary of the present invention, and that various modifications and improvements may be made thereto, without departing from the scope of the present invention.

The invention claim is:

1. A tubing expansion device adapted to be advanced axially through tubing to be expanded and comprising:

a body; and first, second and third actuatable expansion members mounted on the body, each of the expansion members being radially movable independently from one another, wherein the device is adapted to be advanced axially and substantially without rotation to expand the tubing.

2. The device of claim 1, wherein the expansion members are configurable in an expansion configuration to describe a predetermined expansion diameter, the expansion members independently radially inwardly movable from the expansion configuration.

3. The device of claim 2, wherein at least one of the expansion members is adapted to be biased towards the expansion configuration.

4. The device of claim 1, wherein the expansion members are axially spaced.

5. The device of claim 1, wherein the expansion members are circumferentially spaced.

6. The device of claim 1, wherein the device is adapted for operation and location downhole in a drilled bore.

7. The device of claim 1, wherein at least two of the expansion members are independently radially movable relative to the body.

8. The device of claim 7, wherein the expansion members are radially movable relative to the body.

9. The device of claim 1, wherein at least one of the expansion members is rotatable.

10. The device of claim 9, wherein the body has a longitudinal axis and at least one of the expansion members is rotatable about an axis which lies substantially perpendicular to the longitudinal axis of the body.

11. The device of claim 9, wherein a plurality of the expansion members are rotatable.

12. The device of claim 1, wherein at least one of the expansion members is non-rotating.

13. The device of claim 1, comprising further expansion members which are collectively radially movable.

14. The device of claim 13, wherein said further expansion members are located towards a leading end of the device, for providing an initial degree of expansion.

15. The device of claim 1, comprising at least one further expansion member which defines a fixed diameter.

16. The device of claim 15, wherein said at least one further expansion member is located towards a leading end of the device, for providing an initial degree of expansion.

17. The device of claim 1, wherein the expansion members are fluid pressure actuated.

18. The device of claim 17, wherein at least one expansion member is mounted on a piston located in a recess in the body, whereby an elevated pressure within the body urges the piston and the at least one expansion member radially outwardly.

19. The device of claim 1, wherein at least one expansion member is mechanically actuated.

20. The device of claim 1, further comprising means for resiliently biasing at least one of the expansion members radially outwardly.

21. The device of claim 1, further comprising driving means for applying an axial motive force to the body.

22. The device of claim 21, wherein the driving means is arranged to engage tubing in which the device is located.

23. The device of claim 22, in which the driving means comprises a seal member for engaging a tubing inner surface.

24. The device of claim 23, wherein the seal member is adapted for engaging expanded tubing wall.

25. The device of claim 23, wherein the seal member is adapted for engaging unexpanded tubing wall.

26. The device of claim 1, in combination with expandable tubing.

27. The device of claim 26, wherein the tubing is solid-walled.

28. The device of claim 1, further comprising a seal member mounted on the body and adapted for engaging an inner wall of the tubing to be expanded.

29. A tubing expansion device adapted to be advanced axially through tubing to be expanded and comprising:

a body having a longitudinal axis; and a plurality of expansion members mounted on the body, at least one of the expansion members being independently radially movable and at least one of the expansion members being rotatable about an axis which lies substantially perpendicular to the longitudinal axis of the body.

30. A tubing expansion device adapted to be advanced axially through tubing to be expanded, comprising:

a body having a longitudinal axis; and a first set of extendable rollers circumferentially spaced around the body at first angular locations, wherein at least one roller in the first set of extendable rollers is independently radially movable;

a second set of extendable rollers circumferentially spaced around the body at second angular locations angularly offset from the first angular locations, the second set of extendable rollers separated along the longitudinal axis from the first set of extendable rollers, wherein at least one roller in the second set of extendable rollers is independently radially movable, wherein each roller in the first and second sets of extendable rollers is rotatable about an axis which lies substantially perpendicular to the longitudinal axis of the body.

31. The device of claim 30, further comprising an expansion member which defines a fixed diameter.

32. The device of claim 31, wherein the expansion member is located towards a leading end of the device for providing an initial degree of expansion.

33. The device of claim 30, wherein the first and second sets of extendable rollers are hydraulically actuated.

34. The device of claim 30, wherein the first and second sets of extendable rollers include rollers mounted on respective pistons located in recesses in the body, whereby an elevated pressure within the body urges the pistons and the rollers radially outwardly.

* * * * *